United States Patent [19]

Vann

[11] Patent Number: 4,598,771

[45] Date of Patent: Jul. 8, 1986

[54] METHOD AND APPARATUS FOR FIRING A PERFORATING GUN AND SIMULTANEOUSLY RECORDING THE DOWNHOLE PRESSURE

[75] Inventor: Roy R. Vann, Katy, Tex.

[73] Assignee: Geo Vann, Inc., Houston, Tex.

[21] Appl. No.: 706,587

[22] Filed: Feb. 28, 1985

Related U.S. Application Data

[60] Division of Ser. No. 453,994, Dec. 28, 1982, abandoned, which is a continuation-in-part of Ser. No. 236,869, Feb. 23, 1981, abandoned.

[51] Int. Cl.[4] ..... E21B 43/11; E21B 47/06

[52] U.S. Cl. ..... 166/250; 166/297; 175/4.55; 73/155

[58] Field of Search ..... 166/250, 66, 113, 73, 166/297, 271; 175/4.52–4.56, 48, 103; 173/155

[56] References Cited

U.S. PATENT DOCUMENTS

| | | | |
|---|---|---|---|
| 2,360,742 | 10/1944 | Toth et al. | 73/155 |
| 3,637,012 | 1/1972 | Sizer et al. | 166/250 |
| 3,706,344 | 12/1972 | Vann | 166/297 |
| 3,717,095 | 2/1973 | Vann | 175/4.55 X |
| 3,871,448 | 3/1975 | Vann et al. | 166/128 |
| 3,931,855 | 2/1976 | Vann et al. | 166/128 |
| 4,040,485 | 8/1977 | Vann et al. | 166/297 |
| 4,151,880 | 5/1979 | Vann | 166/314 |

*Primary Examiner*—Stephen J. Novosad
*Assistant Examiner*—Thuy M. Bui
*Attorney, Agent, or Firm*—James R. Duzan; Eugene L. Flanagan, III

[57] ABSTRACT

An improved downhole pressure measuring apparatus includes a flow tube conveying pressurized fluid from a fluid source on the surface into a borehole. The fluid flow and pressure is measured at the surface and the downhole pressure is determined.

A perforating gun firing mechanism may be attached to a lower end of the flow tube and positioned in the borehole respective to a perforating gun for the firing thereof. The gun is fired by manipulating the flow tubing and the downhole pressure is simultaneously recorded.

8 Claims, 5 Drawing Figures

METHOD AND APPARATUS FOR FIRING A PERFORATING GUN AND SIMULTANEOUSLY RECORDING THE DOWNHOLE PRESSURE

CROSS-REFERENCE TO RELATED APPLICATIONS

This application is a divisional application of application Ser. No. 453,994 filed Dec. 28, 1982 now abandoned which in turn is a continuation-in-part of application Ser. No. 236,869, filed Feb. 23, 1981 now abandoned by Roy R. Vann, and entitled, "Method of Firing Perforating Gun and Simultaneously Recording Downhole Pressure."

BACKGROUND OF THE INVENTION

The present invention relates to completion of oil wells, and more particularly, to an improved method and apparatus for measuring pressure within an oil well, particularly the initial flow pressure for a well.

Initial flow pressure is a plot of absolute pressure sensed from within the borehole near the formation as a function of time at the time of formation perforation. The reaction of the hydrocarbon formation to perforation, as indicated by the initial flow pressure, may be interpreted by an engineer to provide valuable information regarding the hydrocarbon formation, including permeability of the formation, damage to the formation, whether it is necessary to treat the formation, and if so, the type of treatment required. Pressure measurements are also necessary throughout the life of a well to track reservoir depletion and evaluate continued production capability and techniques. Consequently, prompt and reliable pressure measurements are essential for proper evaluation and maintenance of an oil well.

There presently exists on the market several devices for measuring and recording downhole pressure. Most of these devices utilize downhole electronic probes communicating via electric signals to a recording apparatus at the surface. Representative of this type of device is the Lynes Sentry system, manufactured by Lynes, a Division of Baker Drilling Equipment Company, and described on pp. 10–12 of the 1982–83 Lynes Product Catalog, reprinted in IV Composite Catalogs of Oilfield Equipment and Services, 5624–26 (1982–1983).

Electronic-type downhole pressure recording systems are limited by a problem which is common to all electronic systems—electronic devices within the apparatus occasionally fail. When a failed device is located within a unit at the surface, the entire unit containing the failed device may be replaced with a backup unit and little time lost as a result. When the failed electronic device is located within a probe at the bottom of a borehole, however, the probe must be withdrawn to the surface, replaced and lowered back to the bottom of the borehole with a loss of valuable time and an increase in expense. The problem is aggravated and the expense significantly increased when the electronic-type downhole pressure recording system has previously been permanently installed on the tubing string, requiring the entire string to be withdrawn from the borehole.

Electronic-type downhole pressure recording systems are further limited by the fact that they may not be utilized at all in hot well applications, where temperatures may exceed 200 degrees centrigrade. Electronic devices within the downhole probe are typically rated for use at temperatures below 125 degrees centigrade.

Use of the systems in excessive temperatures will result in failure of the electronic devices located therein.

A second type of downhole pressure recording device known as the Pressure Transmission System (PTS) is manufactured by NL Sperry-Sun, a Division of NL Industries, Inc. and described generally in the 1982–1983 Catalog of NL Sperry Sun, reprinted in IV Composite Catalogs of Oilfield Equipment and Services 6425–26 (1982–83). PTS includes a downhole chamber connected by a small-diameter tube to a surface readout unit. The chamber can either be installed permanently on the production string or suspended through a lubricator. The chamber and tube are charged with a single-phase gas (nitrogen or helium) from the surface, the downhole portion of the unit including no electronic devices. A diaphragm on the chamber compresses the enclosed gas in response to the ambient borehole pressure. A pressure gauge at the surface end of the tubing is calibrated to provide a readout of downhole pressure. Although the PTS avoids the difficulties associated with downhole electronics, the system apparently does not work so well as to persuade persons in the oil field industry to use the PTS. It appears that the sensitivity of the PTS to relatively nominal changes in pressure diminishes with increasing length of the tubing connecting the downhole chamber to the surface readout unit. This follows from the limited stroke of the diaphragm on the chamber and the increasing distance and volume of gas through which the minuscule change in pressure must be transported to the surface.

As previously discussed, a loss of time due to replacement of a failed pressure probe within the borehole increases the expense of the operation. This follows from the extreme overhead expenses associated with drilling and completion of an oil well. The expense of oil well completion thus may be limited, not only by the use of competent and reliable apparatus, as addressed above, but also by limiting the number of independent trips into the borehole which are required to complete the well. Hence, it appears that present apparatus and techniques for measuring downhole pressure do not adequately provide for certain hot well applications and can be improved upon in other cooler applications. It further appears that completion expense may be reduced if two or more independent tasks are combined to require but a single trip into the borehole.

SUMMARY OF THE INVENTION

Accordingly, an improved apparatus and method for measuring downhole pressure is provided. The pressure measuring apparatus may support or be used in conjunction with a gun firing mechanism so as to provide means for simultaneously firing a perforating gun and recording downhole pressure. Alternatively, the pressure measuring apparatus may be utilized alone to provide a fast and reliable means for accurately measuring the downhole pressure.

The pressure measuring apparatus comprises a source of pressurized fluid connected to a fluid transport means, such as a flow tube, which extends from the fluid source to a point within a borehole. Fluid is conveyed from the source, into the transport means and into the borehole. A change in downhole pressure is determined by measuring the change in flow from a constant pressure fluid source or by measuring the change in pressure from a constant flow fluid source.

Greater efficiency in well completion is realized by attaching a gun firing mechanism to the downhole end of the fluid transport means. The gun firing mechanism may then be positioned for casing perforation in the same run in which the pressure measuring apparatus is positioned for recording downhole pressure, thereby reducing the time and expense required to complete a well. The perforating gun is fired and the downhole pressure simultaneously measured, immediately providing the reservoir engineer with the data necessary to evaluate the formation and to proceed with well completion.

These and various other objects and advantages of the present invention will become readily apparent to those skilled in the art upon reading the following detailed description and claims and by referring to the accompanying drawings.

DESCRIPTION OF THE PREFERRED EMBODIMENT

Perforation of a cased borehole and testing of the hydrocarbon formation are key steps in the completion of an oil well. Evaluation of test results provides information regarding the size of the reservoir, the type of fluid or gas within the formation, whether the well will free-flow or will require some type of articial lift, the permeability of the formation, formation damage, and other important characteristics. Initial flow pressure is of primary interest in the course of evaluating a hydrocarbon formation. The present invention provides an improved method and apparatus for perforating a cased borehole and simultaneously measuring the initial downhole flow pressure. The present invention also provides a convenient apparatus for relatively rapid insertion into a well so as to determine the pressure therein or, alternatively, an apparatus which may be permanently installed within a producing well so as to provide a continuous readout of downhole pressure.

Figure 1:
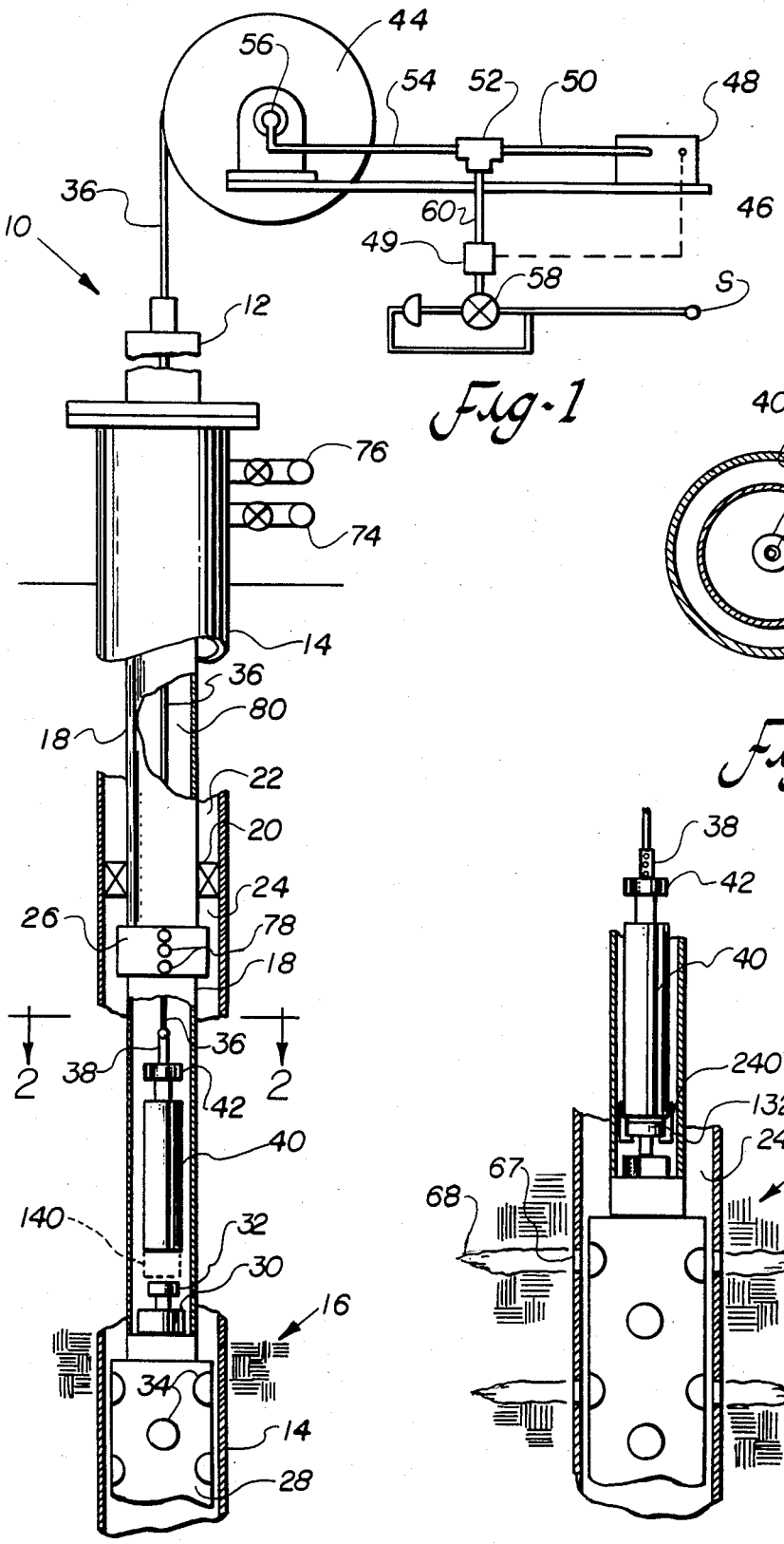
FIG. 1 is a part diagrammatical, part schematical, part cross-sectional view of a borehole having apparatus made in accordance with the present invention.
Figure 2:
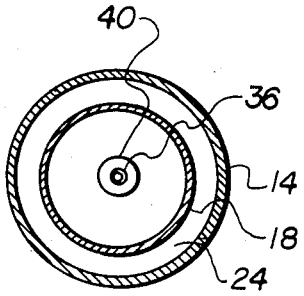
FIG. 2 is a cross-sectional view taken along line 2—2 of FIG. 1.

More particularly, there is shown in FIG. 1 a cased borehole 14 having disposed therein apparatus for completion of a well within a hydrocarbon formation 16. A string of production tubing 18, concentrically disposed within the casing 14, supports a casing gun 28 at a downhole end thereof and defines an annular space between the casing and the production tubing. The casing gun 28 may be any of several apparatus suitable for perforating borehole casing and having firing means upwardly exposed to the interior of the production tubing 18, for example, a jet perforating gun. Casing guns which meet the aforestated requirements are disclosed in greater detail in U.S. Pat. No. 3,706,344 and U.S. Pat. No. 3,717,095, which are hereby incorporated by reference.

The casing gun 28 shown in FIG. 1 includes an impact-type firing head 30, which detonates shaped charges 34 in response to a downwardly directed force of a predetermined minimum magnitude on a T-head 32 of the firing head 30. A force of sufficient magnitude to effect detonation may be generated, for example, by the gravitational force on a weight, such as an elongated metallic bar 40, suspended from the surface through the production tubing 18 and dropped on the T-head 32.

Figure 3:
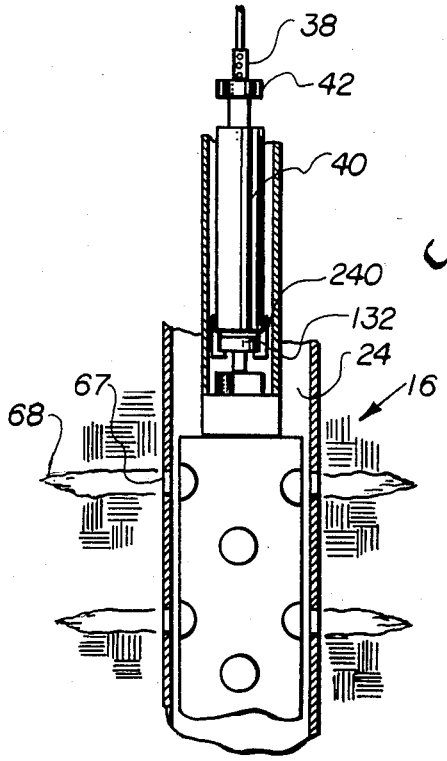
FIG. 3 is an isolated, fragmentary view of an altenative embodiment of part of the apparatus disclosed in FIG. 1.

An alternative embodiment of the firing mechanism, shown in FIG. 3, discloses a pull-type firing head on the perforating gun 28. In this embodiment, the elongated bar 40 includes a clamp 240 at the lower end thereof. The clamp 240 projects downward from the elongated bar 40 and inward to form a hook means. The impact of the clamp 240 lowered against the T-head 132 biases the hook means open until the T-head 132 is engaged by the clamp 240, whereupon the perforating gun may be fired by applying an upward force of predetermined magnitude to the elongated bar 40.

In the case of a typical jet perforating gun, for example, actuation of the firing head 30, whether by impact as shown in FIG. 1 or by pulling as shown in FIG. 3, ignites a fuse (not shown), such as prima cord. The fuse connects a plurality of shaped charges 34 oriented radially outward in the direction of the casing 14. As the fuse burns to each charge, it ignites a booster charge which in turn ignites the shaped charge 34. As the shaped charge burns, it produces a jet-like stream of hot gases which penetrate the casing 14 and the formation 16 to form penetrations 67, 68.

A packet apparatus 20 seals off fluid flow in the annular space between the production tubing 18 and the casing 14 at a point above and relatively near the casing gun 28, to define an upper annulus 22 and a lower annulus 24. A vent assembly 26 is connected in series with the production tubing 18 below the packer apparatus 20 and above the casing gun 28.

The vent assembly 26 includes therein ports 78 which, when opened, permit the flow of production fluids from the lower annulus 24 through the ports 78 and into the interior of the production tubing 18 for transportation to the surfaces. U.S. Pat. Nos. 3,871,448, 3,931,855, 4,040,485, and 4,151,880 show suitable packer and vent assemblies and the actuation thereof in greater detail and are hereby incorporated by reference.

A wellhead 10 at the surface end of the cased borehole 14 includes a pair of outflow ports 74, 76 for producing fluid from the upper annulus 22 and production tubing 18, respectively.

In accordance with the principles of the invention, there is shown in schematic form also in FIG. 1 an apparatus for providing a substantially instantaneous and accurate measurement of borehole pressure as a function of time in the region of formation perforations. The pressure measurement apparatus includes a flow tube 36 spooled at the surface, for example, on a drum 44, which is supported in journaled relationship respective to a suitable frame 46. The flow tube 36 has an upper end connected to a swivel 56 on the drum 44 to permit rotation thereof without deformation of the flow tube 36.

The flow tube 36 preferably comprises stainless steel tubing having dimensions which may vary from 0.5 inch outer diameter (O.D.) by 0.25 inch inner diameter (I.D.) to 1.25 inches O.D. by 0.75 inch I.D. It is also anticipated, however, that in particular applications both smaller, for example, 0.089 inch O.D. by 0.054 inch I.D., and larger, for example 3.5 inch O.D. by 3.0 inch I.D., dimensions may be desirable. The larger volume flow tubing might be preferable, for example, to substantially fill and thereby effectively reduce the volume of the production tubing 18. Suitable stainless steel tubing is available in continuous coiled lengths from various steel manufacturers, such as Armco, Bethlehem Steel Company, and United States Steel.

Figure 4:
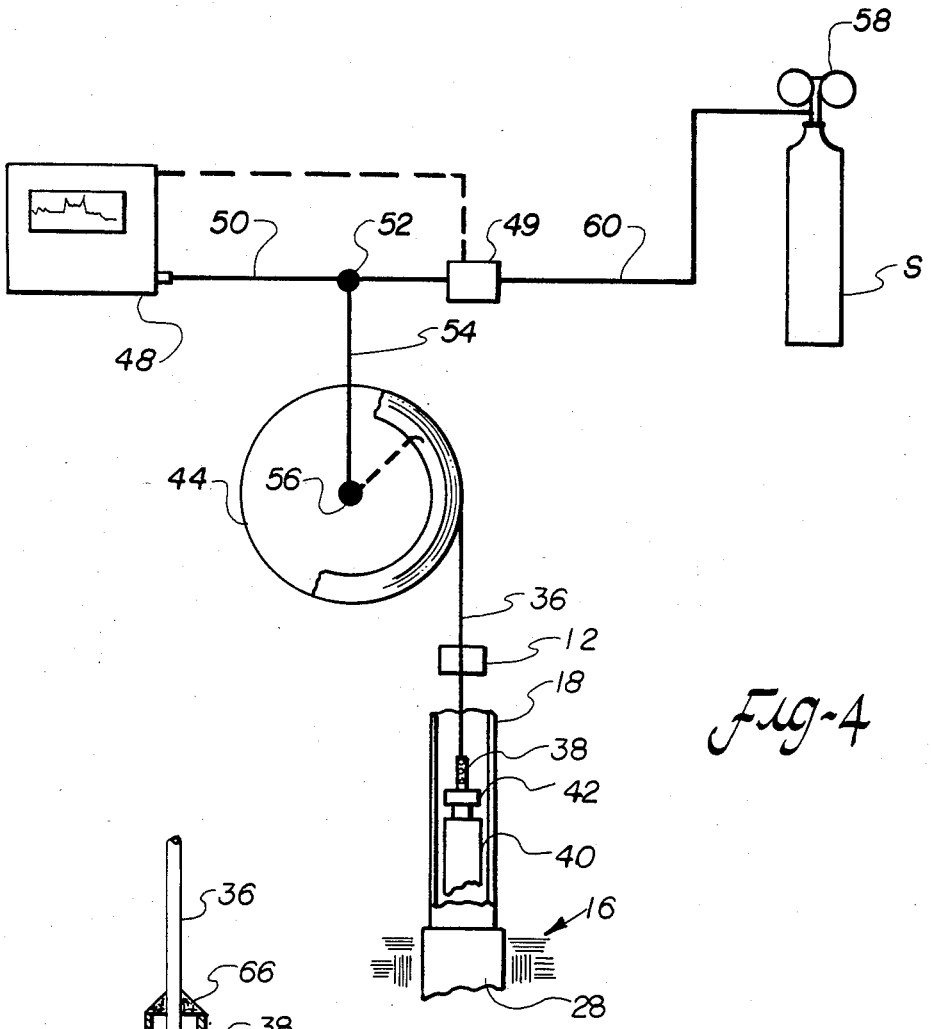
FIG. 4 shows a simplified schematic of the apparatus made in accordance with the present invention and shown in FIG. 1.

FIGS. 1 and 4 show the portion of the pressure measurement apparatus which attaches at the swivel 56. A fluid source, S, provides a flow of a pressurized fluid according to the controlling effect of a pressure regulator 58. The fluid source and the pressure regulator 58 may also be replaced by a suitable pump (not shown) characterized by a constant discharge pressure. The fluid may be compressible or noncompressible fluid. An inert gas, such as nitrogen or helium, would work well as the fluid of the present invention.

Pressurized fluid flows by way of a fluid line 60 through a T-joint 52 and from there to the swivel 56 by way of an adjoining fluid line 54. A flowmeter 49 measures the flow rate of the pressurized fluid through the first fluid line 60 and communicates this flow data to a suitable recording apparatus 48, such as a chart recorder, a digital recorder or a graphic plotter. A third fluid line 50, pressurized by connection to the T-joint 52, provides pressure data to the recording apparatus 48. The pressure regulator 58, the flowmeter 49, and the recording apparatus 48 are well known to those skilled in the art readily available from any of several manufacturers.

Figure 5:
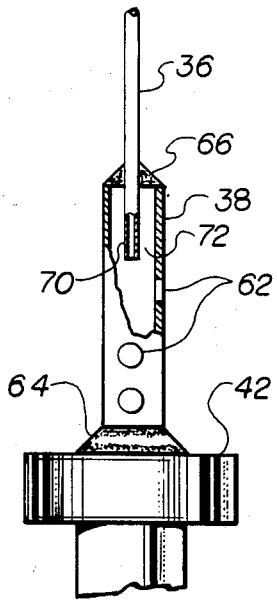
FIG. 5 shows an elevational, part cross-sectional view of a portion of the apparatus disclosed in FIGS. 1–4.

Referring now to FIG. 5, the downhole end of the flow tube 36 is connected to a tool for firing the casing gun 28, such as the elongated bar 40, and is lowered through a lubricator 12 into the production tubing 18. The elongated bar includes at the upper end thereof a fishing neck 42 to which is attached an outlet pipe 38. An open lower end 70 of the flow tube 36 is received within the outlet pipe 38, the upper end of which is rigidly affixed to the flow tube 36 by appropriate means, such as welding at 66. The lower end of the outlet pipe 38 is affixed, for example by welding at 64, to the upper surface of the fishing neck 42. Outlet ports 62 in the outlet pipe 38 permit the efflux of pressurized fluid from the interior 72 of the pipe 28 to the interior of the borehole. Alternatively, the end 70 of flow tube 36 or the ports 62 of the outlet pipe 38 may include check valves (not shown) to insure one-way flow into the borehole, thus preventing fluids from backing up into flow tube 36 should borehole pressure surge to an unanticipated level.

OPERATION OF THE INVENTION

Referring again to FIG. 1, the process of perforating a cased borehole is begun by attaching the casing gun 28 to the lower end of the production tubing 18 and lowering the production tubing 18 into the cased borehole 14 until the gun 28 is positioned adjacent to the hydrocarbon formation 16 to be produced. The packer apparatus 20 is set, sealing the annular space between the casing 14 and the production tubing 18, and the vent assembly 26 is opened to permit fluid flow into the production tubing 18, in accordance with the techniques and procedures revealed by the aforestated patents.

Next, the lubricator 12 is attached to the wellhead 10 in accordance with procedures well known in the art. The downhole end of the flow tube 36, with gun firing mechanism 40 affixed thereto, is then located within the lubricator 12 and subsequently lowered into the production tubing 18 to a predetermined point above the perforating gun 28. The completion process has now proceeded to a point to where the pressure measurement apparatus can be utilized to monitor downhole pressure.

The pressure regulator 58 is adjusted to obtain a desirable rate of fluid flow therethrough. The flow of fluid through the flow tube 36 is measured by the flowmeter 49 and compared by means of the recording apparatus 48 to data obtained by precise empirical calibration of the pressure measuring apparatus before its insertion into the borehole.

Empirical calibration of the pressure measurement apparatus, as a basis for determining downhole pressure, is preferable to a precise measurement of the dimensions and capacities of the apparatus and calculation of the downhole pressure. The pressure at the downhole end of the flow tube 36 is equivalent to the pressure provided by the source at the upstream end of the flow tube 36 in combination with the hydrostatic head of the vertical column of fluid within the flow tube 36, less losses, such as friction, within the system. Because the dimensions and capacities of the apparatus, such as the inner diameter of the tube 36, may vary significantly throughout the apparatus, precise calculation of system losses is difficult. Hence, it is preferable to calibrate the apparatus at the surface before its insertion into the borehole so as to enable a more precise determination of pressure. The apparatus may be calibrated, for example, to relate flow through the flow tube 36, at a fixed source pressure, to a particular pressure at the downhole end of the flow tube 36. In this arrangement, the fluid source S is a constant pressure source providing a flow of fluid at a rate which varies in response to changing downhole pressure. The apparatus is calibrated to correlate flow rate to downhole pressure. The recording apparatus 36 may, for example, include a mircoprocessor which relates the measured flow to the downhole pressure and plots that pressure as a function of time on a chart.

Alternatively, the fluid source S and the pressure regulator 58 may be replaced by a source of fluid flow arranged for delivery at a constant flow rate. The apparatus for measuring downhole pressure by this arrangement would otherwise by unchanged. The downhole pressure then may be determined by the recording apparatus 48 as a function of a change in pressure in the fluid tube 50 at the surface. Once again, precise empirical calibration of the apparatus is necessary so as to relate the surface pressure at a fixed source flow rate to a particular downhole pressure.

The perforating gun 28 is fired by manipulating the flow tube 36 to cause the gun firing mechanism on the lower end thereof to actuate the gun firing head 32. In the case of the apparatus shown in FIG. 1, this is accomplished by lowering the elongated bar 40 against T-head 32 with sufficient force of impact to effect detonation. Referring again to FIG. 3, when the shaped charges 34 of the jet perforating gun are detonated, a plurality of hot gas jets form the perforations 67 in the casing 14 and thereafter perforations 68 in the hydrocarbon formation 16. Production fluid flows from the formation 16 through the perforated casing 14, into the lower annulus 24, through the vent assembly 26, into the production tubing 18 and up to the surface.

During the process of perforation, the pressure measuring apparatus continually monitors and records the downhole pressure as a function of time. It permits the engineer to observe the reaction of the reservoir to perforation, thereby providing him immediately with information necessary to the determination of how properly to complete the well. The pressure measuring apparatus may also be inserted into the well, in a manner similar to lowering a wireline, at times subsequent to completion of the well so as to provide an accurate reading of downhole pressure. Finally, the apparatus may be installed permanently in a well, for example along the exterior of the production tubing, to provide a continuous reading of downhole pressure. Because of the simplicity of the downhole apparatus, the pressure measurement apparatus functions well in a hot well environment which is hostile to other devices and operates essentially trouble-free in other environments.

While a preferred embodiment of the invention has been shown and described, modifications thereof can be made by one skilled in the art without departing from the spirit of the invention.

What is claimed is:

1. In a cased borehole which penetrates a hydrocarbon-containing formation, the method of perforating the casing while measuring the downhole pressure adjacent to the formation, comprising the steps of:

positioning a perforating gun within the casing adjacent to the formation to be completed, the perforating gun being connected to one end of a string of tubing;

attaching a downhole end of a gun firing mechanism to a downhole end of a flow tube;

connecting an uphole end of said flow tube to a pressurized fluid source;

lowering said gun firing mechanism into the borehole through the string of tubing connected to the perforating gun;

establishing a flow of fluid through said flow tube into the borehole;

measuring the flow and pressure of the fluid at the uphole end of said flow tube and determining the pressure at the downhole end thereof; and manipulating the flow tube to fire the perforating gun and simultaneously measuring downhole pressure.

2. A method according to claim 1 further comprising the step of storing said flow tube in wound configuration about a drum which may be rotated to raise and lower said flow tube.

3. A method according to claim 1 wherein the hydrocarbon-containing formation exceeds 125° C. in temperature.

4. A method according to claim 1 wherein said perforating gun is extended into the cased borehole on the end of a string of production tubing.

5. Apparatus for completing a well comprising:

a tubing string;

a packer connected to one end of the tubing string;

a vent located below the packer and connected thereto to allow the flow of fluids from said well into the tubing string after said well has been completed;

a perforating gun having a firing head thereon connected to one end of the vent;

a flow tube reciprocally, removably retained within the tubing string;

apparatus for measuring downhole pressure connected to one end of the flow tube; and means affixed to the other end of the flow tube for firing the perforating gun, whereby the means may be manipulated to fire the gun and changes in downhole pressure as a result of perforation are measured by the measuring apparatus.

6. Apparatus according to claim 5 wherein said measuring apparatus comprises:

a source of fluid, the source providing a generally positive flow of fluid; and means for transporting fluid from the source into the flow tube.

7. Apparatus according to claim 6 wherein the source provides fluid flow at a substantially constant pressure, and wherein the measuring apparatus further comprises:

means for measuring flow through the transporting means and providing an output signal indicative thereof; and means connected to the measuring means for determining downhole pressure.

8. Apparatus according to claim 6 wherein the source provides a generally positive flow of fluid at a substantially constant rate of flow, and wherein the measuring apparatus further comprises:

means connected to the transporting means for measuring the pressure of fluid from the source and providing an output signal indicative thereof; and means connected to the measuring means for determining downhole pressure.

* * * * *